US007814891B2

(12) United States Patent
Lee et al.

(10) Patent No.: US 7,814,891 B2
(45) Date of Patent: Oct. 19, 2010

(54) FUEL PUMP SET

(75) Inventors: Jongsub Lee, Yongin (KR); Il Suk Yang, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 229 days.

(21) Appl. No.: 12/120,913

(22) Filed: May 15, 2008

(65) Prior Publication Data

US 2009/0151704 A1 Jun. 18, 2009

(30) Foreign Application Priority Data

Dec. 13, 2007 (KR) ..... 10-2007-0130416

(51) Int. Cl.
*F02M 59/10* (2006.01)
*F02M 39/00* (2006.01)

(52) U.S. Cl. ..... 123/508

(58) Field of Classification Search ..... 123/507, 123/508

See application file for complete search history.

(56) References Cited

U.S. PATENT DOCUMENTS 2,871,796 A * 2/1959 Dreisin et al. ..... 417/494
3,913,546 A * 10/1975 Clouse ..... 123/501
4,760,831 A * 8/1988 Altdorf ..... 123/501
2004/0139939 A1 * 7/2004 Tsubouchi ..... 123/182.1
2006/0207527 A1 * 9/2006 Saeki et al. ..... 123/54.4

FOREIGN PATENT DOCUMENTS

| | | | |
|---|---|---|---|
| JP | 2000291503 | A * | 10/2000 |
| JP | 2001280222 | A * | 10/2001 |
| JP | 2004-28079 | A | 1/2004 |
| KR | 1994-0009684 | B1 | 10/1994 |
| KR | 2002-0084106 | A | 11/2002 |
| WO | WO 87/00582 | A1 | 1/1987 |
| WO | WO 03095824 | A1 * | 11/2003 |

* cited by examiner

*Primary Examiner*—Stephen K Cronin
*Assistant Examiner*—Arnold Castro
(74) *Attorney, Agent, or Firm*—Morgan, Lewis & Bockius LLP

(57) ABSTRACT

A fuel pump set includes a cam shaft with a cam; a bridge contacting the cam shaft; a head cover attaching the bridge to the cam shaft; and a fuel pump, disposed in the bridge and operable by the cam. The bridge may include two supports, each contacting the cam shaft. One support may have a supporting face, with a shape corresponding to the shape of the cam shaft, with the cam shaft disposed therein. The two supports together may define a shape that widens downward. One support may narrow downward. The set may also include a rod extending from the fuel pump to the cam, reciprocated by the cam. The bridge may include a sealing face supported by the head cover, a groove for preventing rotation of the fuel pump, and/or a breather. The head cover may include an opening in which the fuel pump is disposed.

8 Claims, 5 Drawing Sheets

FUEL PUMP SET

CROSS-REFERENCE TO RELATED APPLICATION

This application claims priority to, and the benefit of, Korean Patent Application No. 10-2007-0130416, filed in the Korean Intellectual Property Office on Dec. 13, 2007, the entire contents of which are incorporated herein by reference.

BACKGROUND OF THE INVENTION (a) Field of the Invention

The present invention relates to a fuel pump set, and more particularly relates to a coupling structure of a fuel pump.

(b) Description of the Related Art

A fuel pump can be driven by a camshaft in a gasoline direct injection (GDI) engine. Fuel is usually pumped in one of two ways. The first creates pressure in a cylinder of the pump using torque of the camshaft. This method makes it difficult to position the pump, and is costly. The other way of pumping fuel using a reciprocating rod, and a follower connected to the camshaft. This method makes it easy to position the pump and is inexpensive, but operating stability is low.

The above information disclosed in this Background section is only for enhancement of understanding of the background of the invention and therefore it may contain information that does not form the prior art that is already known in this country to a person of ordinary skill in the art.

SUMMARY OF THE INVENTION

A fuel pump set includes a cam shaft; a cam on the cam shaft; a bridge contacting the cam shalt; a head cover attaching the bridge to the cam shaft; and a fuel pump, disposed in the bridge and operable by the cam.

The bridge may include a first and a second support, each contacting the cam shaft. The first support may have a supporting face, with a shape corresponding to the shape of the cam shaft, such that the cam shaft is disposed therein. The first support and the second support together may define a shape that widens downward. The first support may define a shape that narrows downward.

The fuel pump set may also include a rod extending from the fuel pump to the cam, reciprocated by the cam.

The bridge may include a sealing face supported by the head cover. The bridge may include a groove for preventing rotation of the fuel pump. The bridge may include a breather. The head cover may include an opening in which the fuel pump is disposed.

Figure 1:
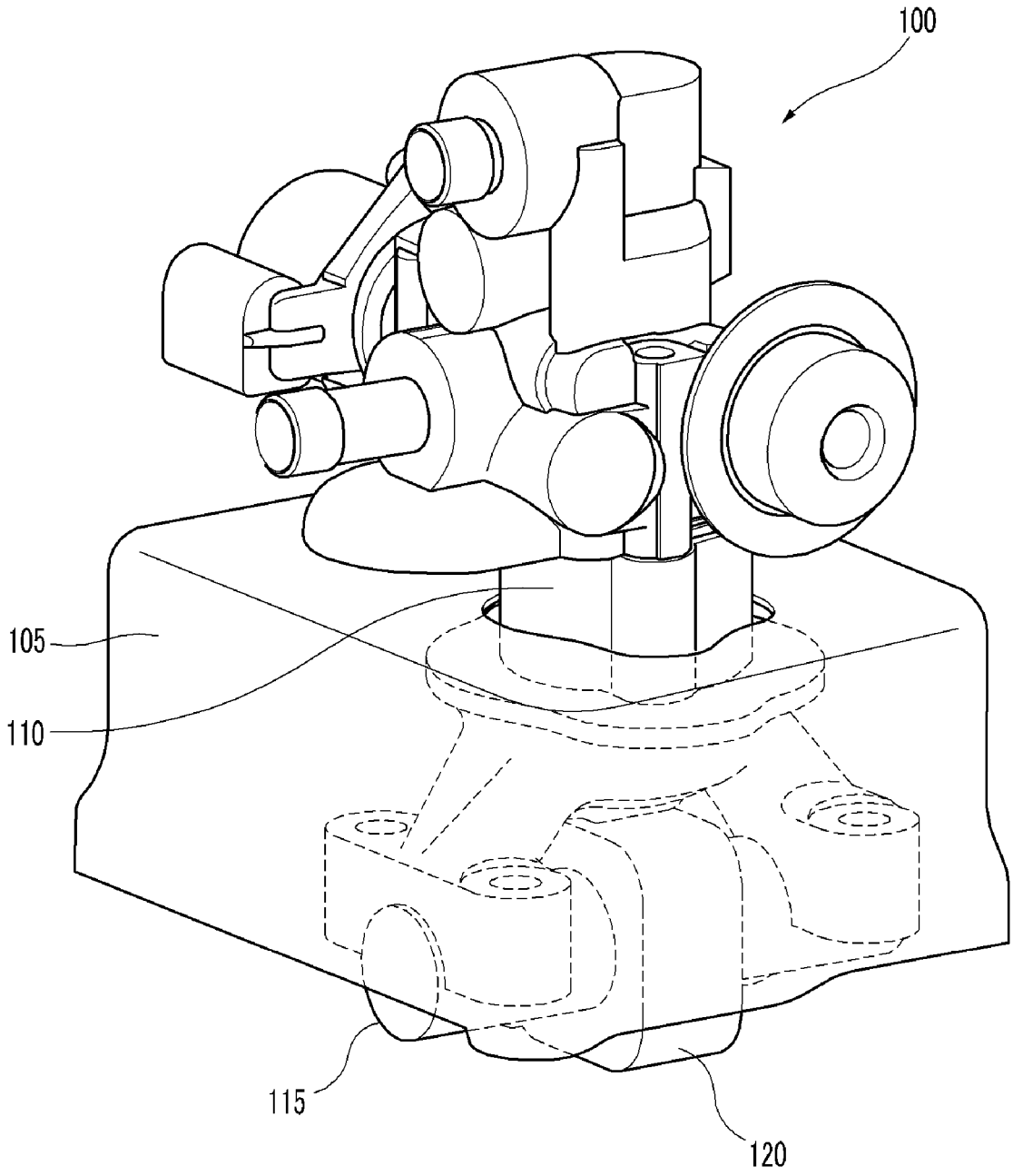
FIG. 1 is a partial perspective view of a fuel pump set according to an exemplary embodiment of the present invention.

| Reference Numerals | |
|---|---|
| 100: | fuel pump |
| 105: | head cover |
| 110: | bridge |
| 115: | cam shaft |
| 120: | cam |
| 200: | supporting face |
| 202a: | first support |
| 202b: | second support |
| 204: | fitting hole |
| 205: | fixing groove |
| 210, 415: | fixing hole |
| 215: | breather |
| 220: | sealing face |
| 222: | groove for preventing rotation |
| 405, 410: | gasket rail |
| 420: | opening |
| 500, 505: | gasket |
| 510: | cylinder head |
| 515: | rod |
| 520: | spring |
| 525: | inlet |
| 530: | outlet |
| 535: | follower |

DETAILED DESCRIPTION OF PREFERRED EMBODIMENTS

The present invention will be described more fully hereinafter with reference to the accompanying drawings, in which exemplary embodiments of the invention are shown. As those skilled in the art will realize, the described embodiments may be modified in various different ways, all without departing from the spirit or scope of the present invention.

Referring to FIG. 1, in some embodiments, a fuel pump set includes a cam 120 on a camshaft 115, a bridge 110, a head cover 105, and a fuel pump 100. A lower end of the bridge 110 contacts the camshaft 115. The bridge 110 is fixed securely to the camshaft 115 by the head cover 105. The fuel pump 100 is disposed in an upper portion of the bridge 110. The fuel pump 100 is driven by a rod 515 (FIG. 5) and a follower 535 (FIG. 5) that are reciprocated by the cam 120.

Figure 2A:
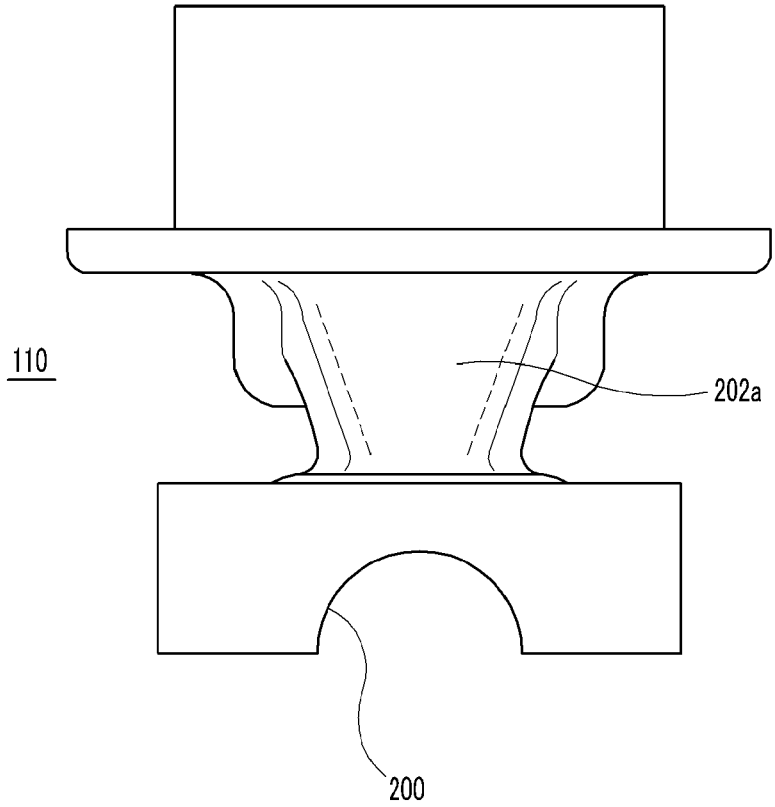
FIG. 2A is a side view of the bridge shown in FIG. 1.

Referring to FIG. 2A, in some-embodiments, the bridge 110 includes a first support 202*a*, which narrows from top to bottom. Accordingly, the bridge 110 is light. A supporting face 200 at the bottom of the first support 202*a* is circular, and the camshaft 115 is situated within the supporting face 200.

Figure 2B:
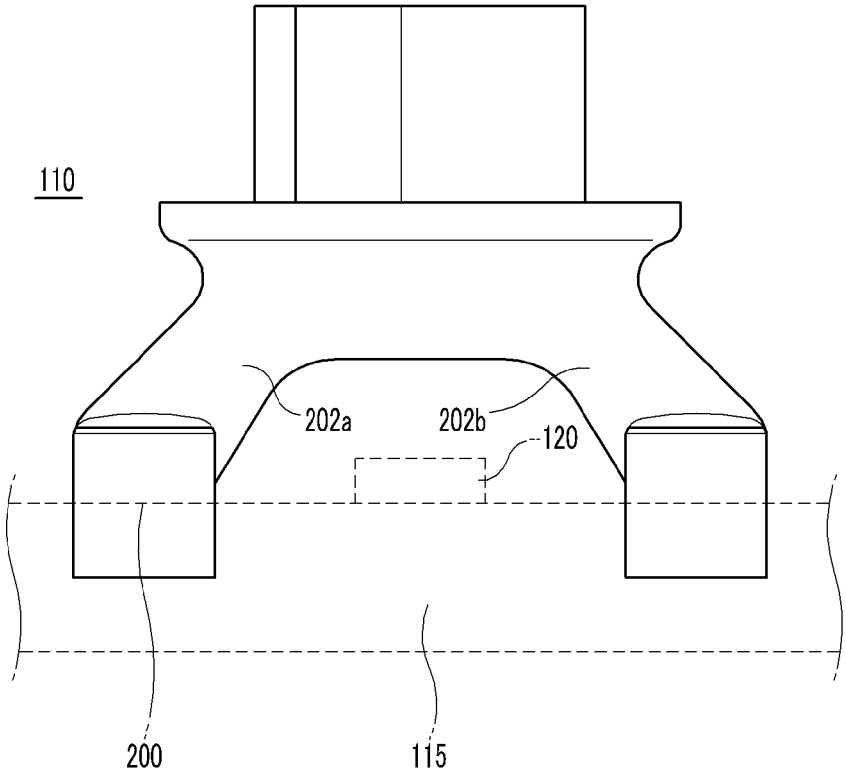
FIG. 2B is a front view of the bridge of FIG. 2A.

As shown in FIG. 2B, in some embodiments, the bridge 110 also includes a second support 202*b*. The supports 202*a*, 202*b* may be trapezoidal, and widen from top to bottom. Accordingly, the coupling structure of the bridge 110 and the camshaft 115 is secure.

Figure 2C:
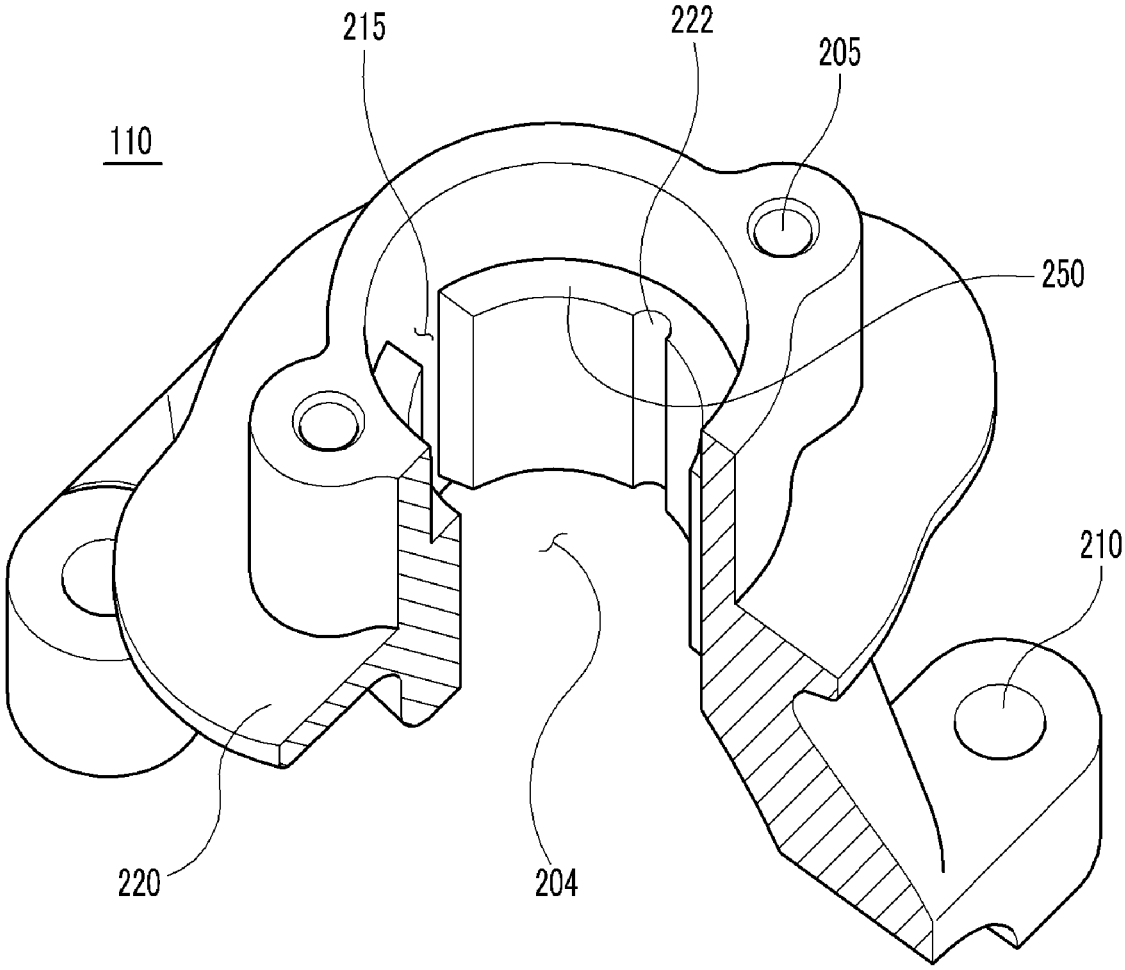
FIG. 2C is a sectional perspective view of the bridge of FIG. 2A.
Figure 5:
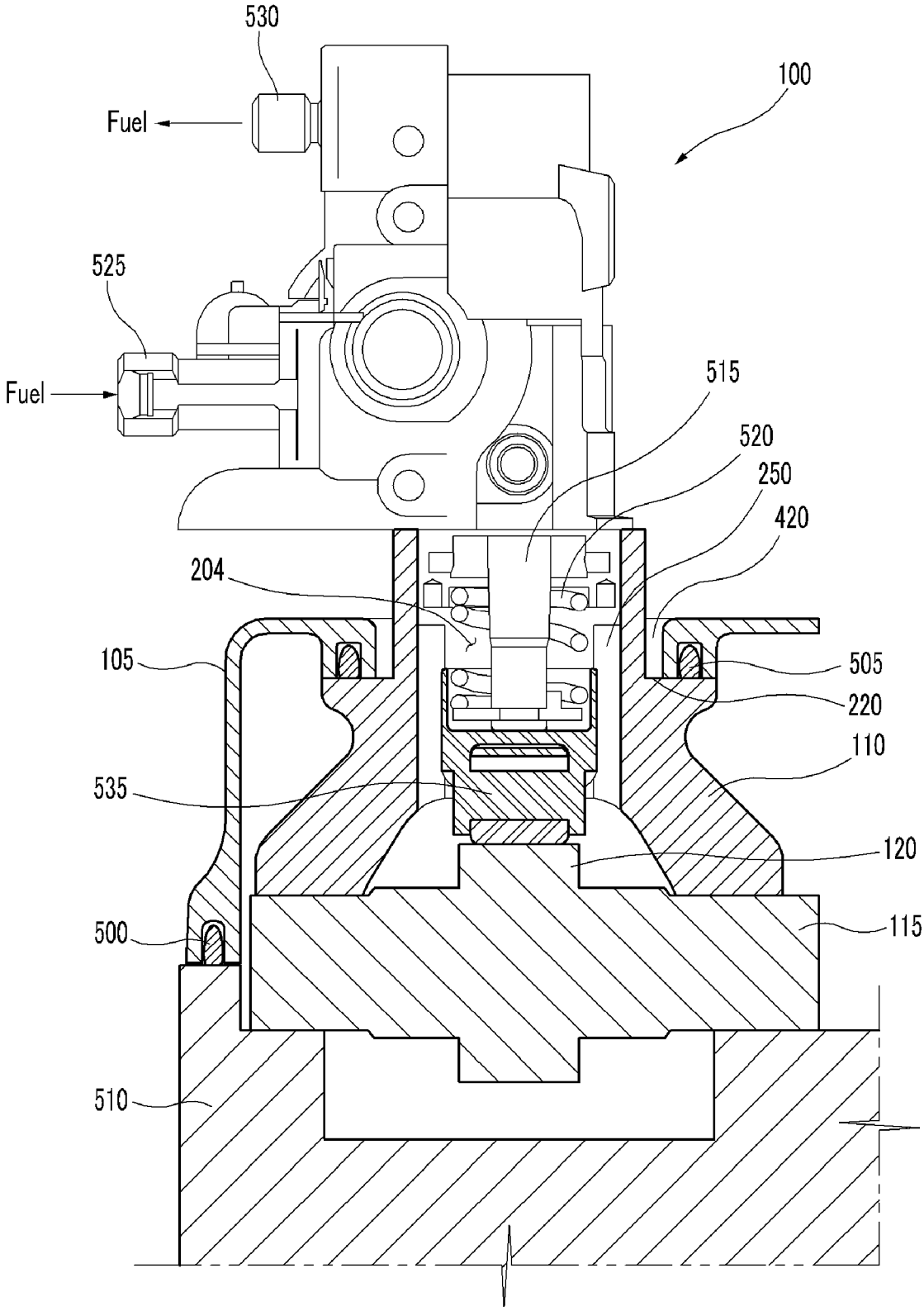
FIG. 5 is a partial cross-sectional view of the fuel pump set of FIG. 1.

As shown in FIG. 2C, the bridge 110 may further include a fitting hole 204 into which the rod 515 (FIG. 5) and the follower 535 (FIG. 5) of the fuel pump 100 are disposed. A step 250 is formed in the fitting hole 204 along an inner circumference thereof, as can be seen in FIG. 2C. A breather 215 is formed at a lateral side of the step 250 and the step 250 may include a groove 222 for preventing rotation. A fixing groove 205 are also provided on the bridge 110. Also, a fixing hole 210 is provided near the bottom of the bridge 110. The bridge 110 can be bolted to a cylinder head 510 (FIG. 5) through the fixing hole 210. The breather 215 is a pathway that exhausts pressure from inside the head cover 105 (FIG. 5). The groove 222 prevents rotation of the fuel pump 100. A fixing groove 205 is provided near the top of the bridge 110.

The fuel pump 100 can be bolted to the fixing groove 205. A sealing face 220 is defined at an edge of the bridge 110. The head cover 105 securely supports the sealing face 220 in a direction of the cylinder head 510 (FIG. 5).

Figure 3:
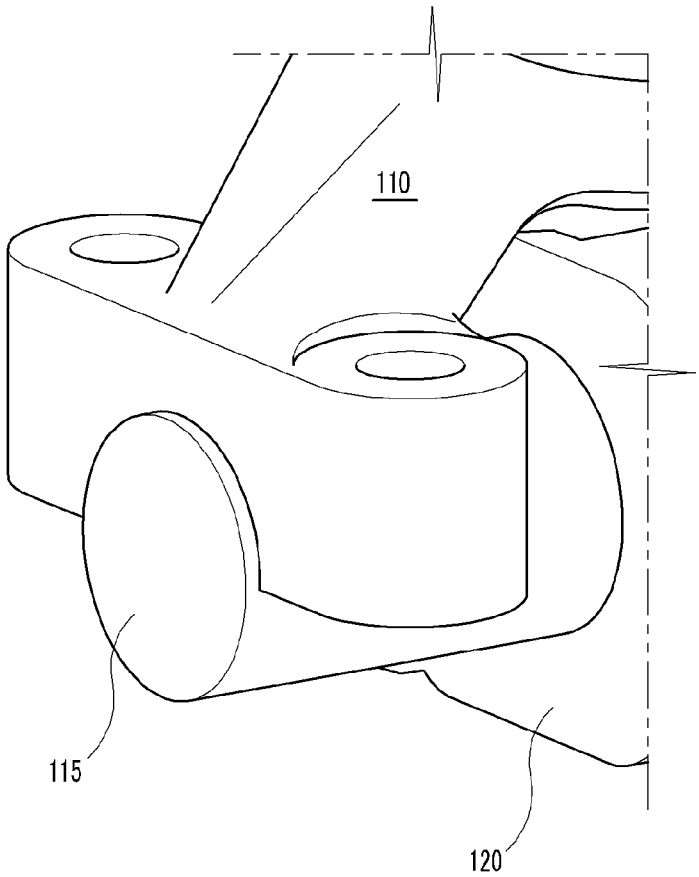
FIG. 3 is a partial perspective view of a bridge and a camshaft shown in FIG. 1.

As shown in FIG. 3, the camshaft 115 is disposed in, and rotates within, the supporting face 200 (FIG. 2A). The camshaft 115 is fixed securely by the bridge 110.

Figure 4:
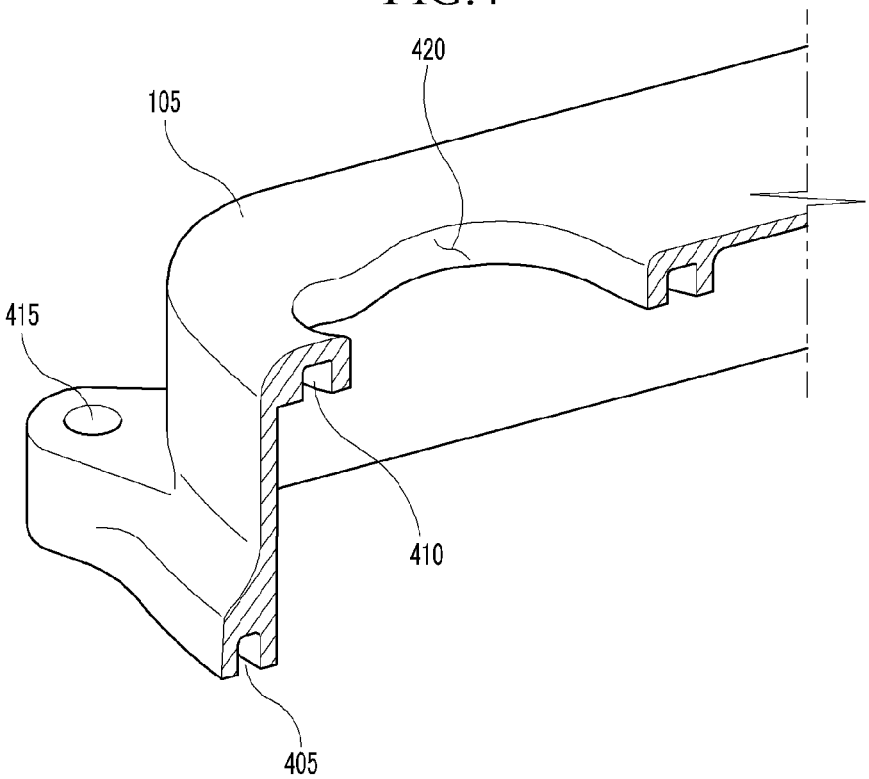
FIG. 4 is a partial sectional perspective view of a head cover shown in FIG. 1.

Referring to FIG. 4, an opening 420 is provided in the head cover 105. The bridge 110 (FIG. 5) protrudes out of the head cover 105 through the opening 420. A first gasket rail 405 is formed corresponding to a lower edge of the head cover 105. A first gasket (500, FIG. 5) is disposed in the first gasket rail 405. A second gasket rail 410 is formed corresponding to the opening 420 of the inner side of the head cover 105. A second gasket (505, FIG. 5) is disposed in the second gasket rail 410. A fixing hole 415 is formed in one side of an edge of the head cover 105. The head cover 105 is fixed securely to the cylinder head (510, FIG. 5) by screwing a bolt (not shown) through the fixing hole 415.

As shown in FIG. 5, the camshaft 115 is disposed at an upper face of the cylinder head 510. The bridge 110 is installed on the camshaft 115. The fuel pump 100 is disposed in an upper end face of the bridge 110. An inlet 525 for fuel entry and an outlet 530 for fuel exit are formed in the fuel pump 100. The rod 515 is disposed in the fuel pump 100, through the fitting hole 204 of the bridge 110. The follower 535 is disposed at the end of the rod 515. The follower 535 and the rod 515 reciprocate vertically by the cam 120. A spring 520 is disposed around the rod 515 to help the rod 515 vertically reciprocate.

A lower portion of the head cover 105 is fixed to the cylinder head 510, and the head cover 105 securely supports the bridge 110 in a direction of the camshaft 115. Accordingly, the bridge 110 is supported by the head cover 105.

The first gasket 500 is interposed between the head cover 105 and the cylinder head 510, and the second gasket 505 is interposed between the head cover 105 and the sealing face 220 of the bridge 110.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A fuel pump set, comprising:

a cam shaft;

a rod connected to a fuel pump;

a cam disposed on the cam shaft and rotatably engaged with the rod;

a bridge contacting the cam shaft and including:

a fitting hole, wherein a step is formed along a inner circumference of the fitting hole and includes a groove formed therein in a longitudinal direction of the fitting hole, and the rod is slidably coupled to the groove; and a breather formed at a lateral side of the step in a longitudinal direction of the fitting hole such that a pressure inside a head cover is adjusted therethrough;

the head cover attaching the bridge to the cam shaft; and the fuel pump, disposed in the bridge and operable by the cam.

2. The fuel pump set of claim 1, wherein the bridge comprises a first support contacting the cam shaft, and a second support contacting the cam shaft.

3. The fuel pump set of claim 2, wherein the first support comprises a supporting face, comprising a shape corresponding to a shape of the cam shaft, such that the cam shaft is disposed therein.

4. The fuel pump set of claim 2, wherein the first support and the second support define a shape that widens downward.

5. The fuel pump set of claim 2, wherein the first support defines a shape that narrows downward.

6. The fuel pump set of claim 1, wherein the rod extends from the fuel pump to the cam, reciprocated by the cam.

7. The fuel pump set of claim 1, wherein the bridge comprises a sealing face supported by the head cover.

8. The fuel pump set of claim 1, wherein the head cover comprises an opening in which the fuel pump is disposed.

* * * * *